United States Patent [19]

Kataishi et al.

[11] Patent Number: 4,457,628

[45] Date of Patent: Jul. 3, 1984

[54] STIRRING APPARATUS

[75] Inventors: Takao Kataishi; Nobufumi Yokoi, both of Tokyo, Japan

[73] Assignee: Misawa Home Co., Ltd., Tokyo, Japan

[21] Appl. No.: 325,898

[22] Filed: Nov. 30, 1981

[30] Foreign Application Priority Data

Jul. 23, 1981 [JP] Japan ..... 56-115681

[51] Int. Cl.[3] ..... B28C 5/12

[52] U.S. Cl. ..... 366/67; 366/64; 366/332; 366/333

[58] Field of Search ..... 366/64, 332, 333, 334, 366/335, 256, 257, 309, 312, 313, 260, 346, 327, 328, 329, 241, 67

[56] References Cited

U.S. PATENT DOCUMENTS

| | | | |
|---|---|---|---|
| 86,002 | 1/1869 | Coffman | 366/332 |
| 361,642 | 4/1887 | Parker | 366/332 |
| 500,073 | 6/1893 | McLennan | 366/332 |
| 1,018,255 | 2/1912 | Miller | 366/332 |
| 1,019,175 | 3/1912 | Moore | 366/346 |
| 2,191,578 | 2/1940 | Money | 366/256 |
| 2,392,731 | 1/1946 | Fox | 366/327 |

FOREIGN PATENT DOCUMENTS

| | | | |
|---|---|---|---|
| 1255549 | 11/1967 | Fed. Rep. of Germany | 366/64 |

*Primary Examiner*—Stephen Marcus
*Assistant Examiner*—Brian J. Bowman
*Attorney, Agent, or Firm*—Flynn, Thiel, Boutell & Tanis

[57] ABSTRACT

A stirring apparatus is disclosed for stirring mortar or the like, wherein foaming is controlled to the minimum, and moreover, satisfactory stirring effects can be obtained.

This apparatus has a roof-shaped stirring blade including two plate-like members inclined to each other, each of which is provided therein with a plurality of flow holes, the stirring blade being reciprocated in the mortar tank.

11 Claims, 3 Drawing Figures

STIRRING APPARATUS

BACKGROUND OF THE INVENTION

1. Field of the Invention

The present invention relates to stirring apparatuses, and more particularly to a stirring apparatus for preventing an article to be stirred from foaming.

2. Description of the Prior Art

Concrete panels have been commonly used as a construction material. In recent years, there has been adopted a cellular concrete panel in order to utilize advantages of both concrete and wood such as the material quality of the concrete panel of the type as described, that is, one which, while being a concrete panel, is further rendered light in weight and satisfactory in heat insulating property.

There has been proposed the following process as a process of producing a cellular concrete panel. Firstly, steel in coil form for a framework is combined together lengthwise and crosswise to form a metal screen, and the outer periphery of this metal screen consisting of the steel bar in coil form is fixed to a frame. The framework thus formed is degreased, rinsed and immersed in a mortar liquid so as to be corrosionprotected, thereafter, set in a shuttering, then a slurry containing cement, an admixture, water and so forth is poured into this shuttering, the surface thereof is smoothed by means of a smoothing member, and temporarily cured for a certain period of time.

Upon completion of the temporary curing, the semi-product thus produced is removed from the shuttering. A plurality of such semi-products are put together and water-splashed in a pre-curing step, and thereafter, put into an autoclave where the semi-products are cured at high temperature and under high pressure. Upon completion of curing, the panels thus obtained are subjected to finish-coating and the like, and then, stocked as finished products.

In order to prevent a heavy-weight content contained in the mortar from settling in a mortar tank, into which a reinforcement-arranged frame for a concrete panel is immersed during the process of producing the concrete panels as described above, it is necessary to suitably effect the stirring operation. Apparatuses having screw-shaped rotor fins have been commonly used as the stirring means in the prior art. However, in that case, such a disadvantage has been presented that foams are easily formed in the mortar, whereby the corrosion protection effects for the reinforcement-arranged frame immersed in the mortar become less effectual. Additionally, a method of manually stirring the mortar, during which the foaming is tried to be controlled, is very low in the workability, and moreover, rather impracticable because the mortar is heavy in weight and stirred with difficulty. Therefore, necessity has been voiced for the provision of a stirring apparatus, wherein the foaming is prevented and the stirring is highly effectual.

SUMMARY OF THE INVENTION

The present invention has as its object the provision of a stirring apparatus, wherein the foaming is kept low during stirring and the stirring is satisfactorily effectual.

The present invention contemplates to provide a stirring apparatus, wherein a roof-shaped stirring blade is formed by two plate members inclined to each other, a plurality of flow holes are formed in these plate members, respectively, and the stirring blade is reciprocated in a stirring tank to effect stirring, thereby enabling to achieve the abovedescribed object.

DETAILED DESCRIPTION OF THE PREFERRED EMBODIMENT

Description will hereunder be given of an embodiment of the present invention.

Figure 1:
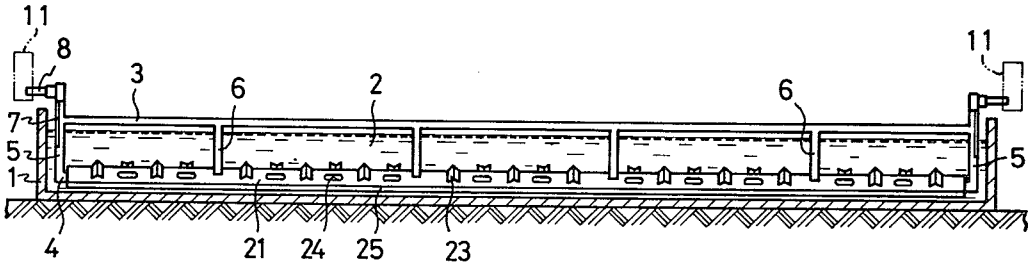
FIG. 1 is a front view showing the general arrangement of an embodiment of the stirring apparatus according to the present invention.
Figure 2:
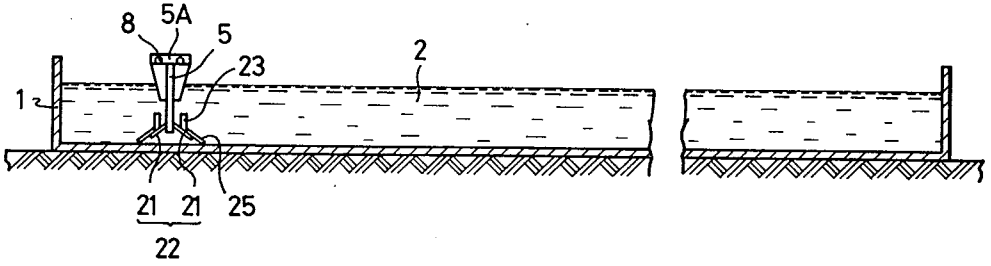
FIG. 2 is a right side view of FIG. 1.

FIGS. 1 and 2 show an embodiment, in which the stirring apparatus according to the present invention is applied to a mortar tank. In these drawings, a mortar tank 1 having large capacity as a stirring tank is formed into a flat and elongate rectangular parallelepiped form, which is filled with mortar 2 to a predetermined height thereof.

Furthermore, in the mortar tank 1, an upper support rod 3 and a lower support rod 4 are provided in the mortar tank 1, these rods horizontally extending over substantially the entire width of the mortar tank 1. These rods 3 and 4 are formed into square pillar forms, connected to end supports 5 in opposite end portions thereof and disposed in vertically upper and lower portions through end supports and a plurality of intermediate supports 6, and held parallel to each other to form a support frame.

Figure 3:
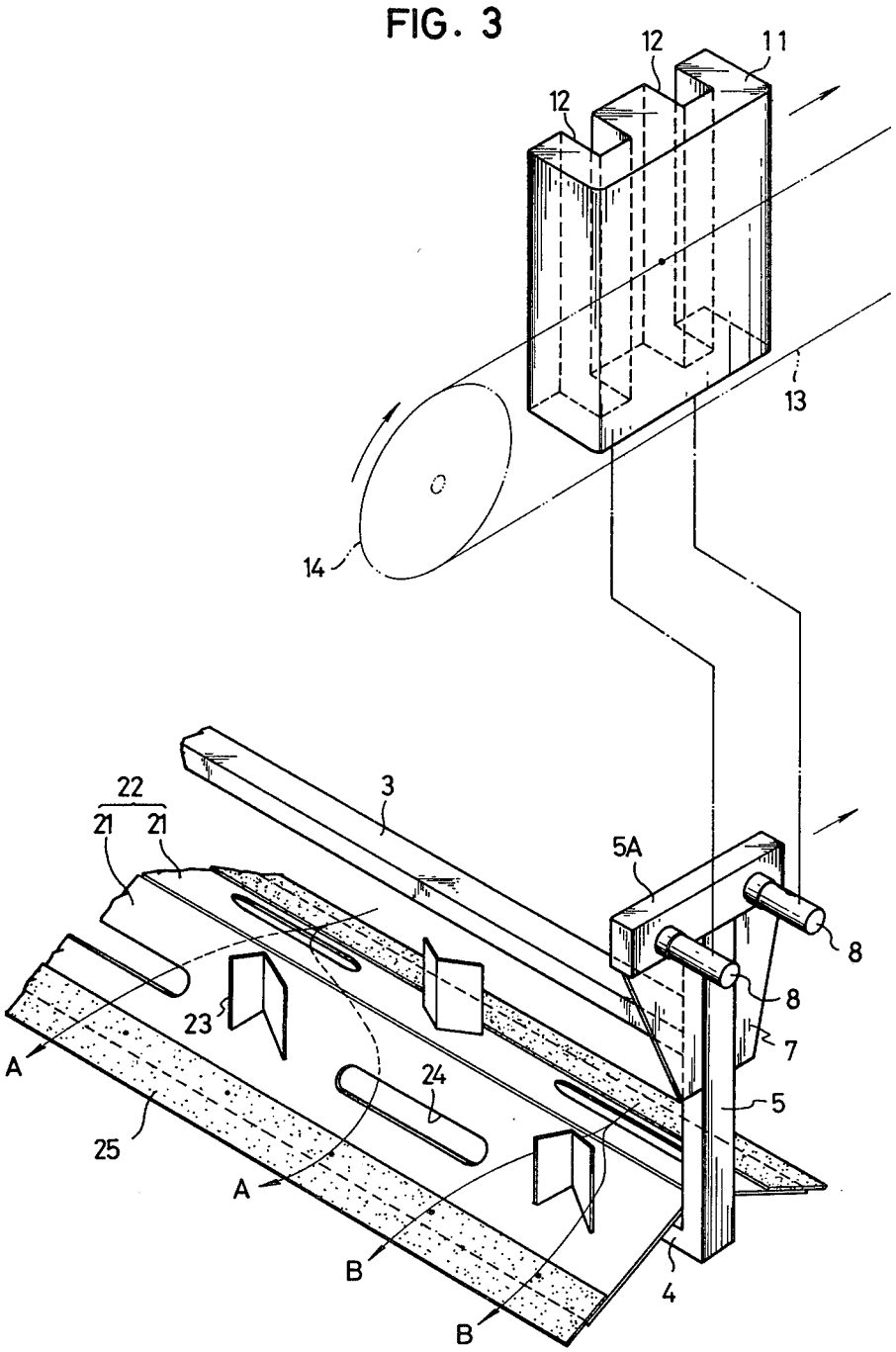
FIG. 3 is an enlarged, disassembled perspective view of the essential portions of the abovedescribed embodiment.

As shown in FIG. 3, end supports 5 are each formed into a T-shape by use of square pillar members, and each of the end supports 5 is provided thereon with support wings 7 being of substantially triangular shapes. Cross portions 5A of the end supports 5 are outwardly projectingly provided thereon with two guide pins 8 at heights equal to each other, and the forward ends of these pins 8 are projected outwardly from the motar tank 1 (refer to FIG. 1).

These two guide pins 8 are slidably coupled into two vertical grooves 12 of chain dogs 11, respectively, outside the mortar tank 1. The chain dogs 11 are rotatably engaged with endless transfer chains 13, and, as these transfer chains 13 are rotated by means of a driving sprockets 14, the chain dogs 11 are accordingly reciprocated in the longitudinal direction of the mortar tank 1, with the chain dogs 11 being moved in a vertically erected state all the time. Consequently, when the chain dogs 11 are transferred to the left in FIG 3, the guide pins 8 are positioned at the lower end portion of the vertical grooves 12, whereas, when the chain dogs 11 are transferred to the right in FIG. 3 by means of the sprockets 14, the guide pins 8 are positioned at the upper end portion of the vertical grooves 12, and, in either case, the guide pins 8 are reciprocated at the same height in the horizontal direction.

Upwardly projected from the mortar tank 1 is the upper support rod 3, and out of the two upper and lower support rods 3 and 4 being reciprocated by the transfer chain 13 through the guide pins 8 in the horizontal direction in the mortar tank 1, the lower support rod 4 is comparatively deeply submerged in the mortar 2.

The lower support rod 4 being reciprocated in this mortar 2 is longitudinally provided thereon with a roof-shaped stirring blade 22 formed by two plate members 21 formed of aluminum plates inclined to each other.

The plate members 21 of the stirring blade 22 are longitudinally provided thereon with projecting pieces 23 and flow holes 24 alternately, and formed at a position on one of the plate members 21 corresponding to a position on the other of the plate members 21 where a projecting piece 23 is provided is a flow hole 24 instead of a projecting piece 23 and vice versa. The projecting piece 23 is formed of a short metal plate piece being of a substantially V-shaped in cross section or of a so-called L-shaped angle material, while the flow hole 24 is formed into a longitudinally elongate elliptic hole in the longitudinal direction of the plate members 21.

Secured to the respective lower end portions of the plate members 21 are rubber sheets or strips 25 as flexible plate-like pieces each having a predetermined width over substantially the entire longitudinal length of the plate member 21, and the lower end edges of these rubber sheets 25 are adapted to lightly abut against the bottom surface of the mortar tank 1.

Description will now be given of action of this embodiment.

When the sprockets 14 are driven in the clockwise direction in FIG. 3 to transfer the chain dogs 11 to the right, the stirring blade 22 is transferred to the right in the mortar tank 1. In this case, a heavy content of the mortar 2, which tends to settle in the mortar tank 1, is scooped upwardly by means of the stirring blade 22 and part of the mortar 2 in the mortar tank 1 flows into the flow holes 24, is divided into flows in the stirring blade 22, and thereafter, the resultant divided flows flow out through the flow holes 24 as indicated by arrows A in the drawing. Meanwhile, a flow of the mortar 2 overflowing the upper portion of the stirring blade 22 is divided into flows by means of the projecting pieces 23, and then the resultant divided flows move to the rear as indicated by arrows B. In this case, no mortar 2 is accumulated at the top portion of the stirring blade 22.

When the stirring blade 22 is transferred in the mortar tank 1 as described above, the mortar 2 is divided into flows and the resultant divided flows are mixed with one another, thus stirring the mortar 2. What differs from the case where the stirring is effected by means of the screw-shaped rotor fin and the like is the fact that, in this case, swirls and the like are not generated in the flow of the mortar and the occurrence of the divided flows of the mortar 2 and the mixed flows between those divided flows quietly progresses in accordance with the movement of the stirring blade 22, so that the foaming in the mortar 2 can be controlled to the minimum.

The abovedescribed embodiment can offer the following advantages.

No foaming occurs in the mortar 2 in accordance with the stirring. Consequently, when the reinforcement-arranged frame is immersed, high corrosion protection effects can be achieved.

Moreover, in particular, the provision of the projecting pieces 23 and the flow holes 24 makes it possible to generate various divided flows in the mortar 2 due to the transfer of the stirring blade 22, and those divided flows are mixed in various ways, so that the stirring effects can be improved to an extremely high extent. Additionally, no stagnant portions are generated at the top portion of the stirring blade 22 due to the projecting pieces 23.

Further, the mortar tank 1 of the large capacity can be accommodated to any volume of mortar. The provision of the rubber sheets 25 at the bottom portions of the plate-like members 21 makes it possible to reliably stir the mortar 2 to the bottom of the mortar tank 1, and no gap or the like will be formed between the bottom of the mortar tank 1 and the stirring blade 22 due to the elasticity of the rubber sheets 25 even if there is a slight wear of the rubber sheets 25.

In the abovedescribed embodiment, the application of the present invention to the stirring of the mortar has been described, however, the articles to be stirred are not limited to the mortar, but may be other fluids or fluidized bodies.

Further, the stirring blade 22 has been provided thereon with the projecting pieces 23, however, the stirring blade 22 may be provided therein only with the flow holes 24. However, when both the projecting pieces 23 and the flow holes 24 are provided, and moreover, both are alternatively provided on the two plate members 21, the stirring effects can be further improved.

Furthermore, the projecting pieces 23 have been formed of the bent metal pieces having V-shaped cross sections, but the projecting pieces 23 should not necessarily be ones described above, but may be mere rod-like members or ones formed by shaving the plate members 21. The forms of the flow holes 24 should not necessarily be slots, but may be ones constituted by a plurality of small holes or ones being of crank-shapes, for example. The rubber sheets 25 are not necessarily indispensable, however, the provision of the rubber sheets 25 makes it possible to facilitate scooping upwardly the heavy content in the mortar without damaging the bottom of the mortar tank 1.

Furthermore, the stirring side 22 has been reciprocated by the endless chains 13 and the chain dogs 11, both of which are provided at opposite sides of the mortar tank 1, however, any other type of driving means may be adopted, for example, driving means of reciprocating crankshaft type may be used.

What is claimed is:

1. A stirring apparatus adapted for stirring mortar, comprising:

an elongated mortar tank for containing the mortar, said tank having a bottom wall, a pair of upright side walls extending upwardly from said bottom wall on opposite sides of said tank and upright end walls extending upwardly from said bottom wall and extending between said side walls at the opposite ends of said tank, said side walls extending in the lengthwise direction of said tank;

a pair of end supports disposed inside said tank, located close to said side walls, respectively, and mounted for lengthwise movement in said tank;

a stirring blade disposed inside said tank and being connected to and extending between said end supports, said stirring blade having a cross-sectional shape of an inverted V which opens toward said bottom wall, said stirring blade being made of two elongated plate members which are inclined upwardly and in opposite directions toward each other with respect to said bottom wall and whose adjacent upper edges are joined to each other, both of said plate members having a series of longitudinally spaced-apart flow holes therethrough, the series of flow holes in one of said plate members being longitudinally offset from the series of flow holes in the other of said plate members so that the mortar that flows through the series of flow holes in one of said plate members changes direction in order to flow through the series of flow holes in the other of said plate members; both of said plate members also having a series of longitudinally spaced-apart projecting pieces extending upwardly from the upper surface thereof and effective for deflecting the mortar that flows therepast, the series of projecting pieces on one of said plate members being longitudinally offset from the series of projecting pieces on the other of said plate members and being substantially opposed to the flow holes in the other of said plate members; and means for reciprocating said stirring blade lengthwise in said mortar tank.

2. A stirring apparatus as claimed in claim 1, further comprising two elongated flexible planar strips mounted on each of said plate members, each flexible strip extending laterally beyond the lower edge of its associated plate member toward said bottom wall of said tank for sliding contact therewith, each flexible strip also extending longitudinally substantially the entire length of its associated plate.

3. A stirring apparatus as claimed in claim 1, wherein said projecting pieces comprise upright V-shaped members, the V-shaped members of each one of said plate members opening horizontally in the same direction, the V-shaped members on one of said plate members opening horizontally in a direction opposite to the V-shaped members of the other plate member.

4. A stirring apparatus adapted for stirring mortar, comprising:

an elongated mortar tank for containing the mortar, said tank having a bottom wall, a pair of upright side walls extending upwardly from said bottom wall on opposite sides of said tank and upright end walls extending upwardly from said bottom wall and extending between said side walls at the opposite ends of said tank, said side walls extending in the lengthwise direction of said tank;

a pair of upright end supports disposed inside said tank, located close to said side walls, respectively, and mounted for lengthwise movement in said tank;

upper and lower support rods extending between said end supports and substantially parallel with said bottom wall of said tank;

a stirring blade disposed inside said tank and being supported by said lower support rod and extending between said end supports, said stirring blade having a cross-sectional shape of an inverted V which opens toward said bottom wall, said stirring blade being made of two elongated plate members which are inclined upwardly and in opposite directions toward each other with respect to said bottom wall and whose adjacent upper edges are joined to each other, both of said plate members having a series of longitudinally spaced-apart flow holes therethrough, the series of flow holes in one of said plate members being longitudinally offset from the series of flow holes in the other of said plate members so that the mortar that flows through the series of flow holes in one of said plate members changes direction in order to flow through the series of flow holes in the other of said plate members; both of said plate members also having a series of longitudinally spaced-apart projecting pieces extending upwardly from the upper surface thereof and effective for deflecting the mortar that flows therepast, the series of projecting pieces on one of said plate members being longitudinally offset from the series of projecting pieces on the other of said plate members and being substantially opposed to the flow holes in the other of said plate members, said flow holes being elongated in the lengthwise directions of said plate members and being narrow in the transverse directions of said plate members, said projecting pieces being V-shaped in cross section with the walls thereof flaring in a direction away from the upper edges of said plate members, each of said plate members having an elongated flexible planar strip extending from the lower edge thereof into substantial sliding contact with said bottom wall of said tank, said strip extending substantially the entire length of its associated plate member; and means for reciprocating said stirring blade lengthwise in said mortar tank.

5. A stirring apparatus as claimed in claim 4, wherein said reciprocating means comprises two pairs of rotatable sprockets on opposite sides of said tank, each pair being positioned near opposite ends of said tank, a pair of endless chains engaged with each of said pairs of sprockets for clockwise or counterclockwise movement thereon, a pair of chain dogs mounted on each of said chains which engage said support frame, and means for driving said sprockets.

6. A stirring apparatus as claimed in claim 5, wherein said end supports each comprise a pair of T-shaped members, wherein each T-shape defines a plane perpendicular to the longitudinal direction of said stirring blade, said T-shaped members extending upwardly from said lower support rod, each of said T-shaped members having mounted thereon a plurality of guide pins which extend parallel to the longitudinal direction of said stirring blade and away from said stirring blade, said guide pins being engaged by said chain dogs.

7. A stirring apparatus as claimed in claim 6, wherein said chain dogs have a plurality of vertically elongated grooves therein, and said pins are vertically slidably engaged in said grooves.

8. A stirring apparatus adapted for stirring mortar, comprising:

a movable support frame including a pair of vertical supports; and an elongated stirring blade which is suspended from said vertical supports, said stirring blade comprising a pair of elongated rectangular plate members having a common longitudinal edge and defining an obtuse angle between the lower surfaces thereof, such that said blade has a downwardly opening V-shape, both of said plate members having a longitudinally extending series of alternating openings and projections formed thereon, said openings extending through the associated plate member, and said projections extending upwardly from the upper sides of the associated plate member, both of said series being parallel with and longitudinally offset from each other such that the projections of one plate member are laterally aligned with openings of the other plate member.

9. A stirring apparatus adapted for stirring concrete mortar, comprising:

an elongated mortar tank having a pair of elongated vertical side walls and a horizontal bed;

a support frame spanning the width of said tank, said frame comprising a pair of vertical end supports disposed in opposing positions each in close proximity to one of said side walls of said tank, and at least one horizontal support rod connected at opposite ends thereof with said vertical end supports;

an elongated stirring blade which is supported on said horizontal support rod of said support frame, said vertical end supports extending upwardly from said stirring blade, said stirring blade comprising a pair of rectangular plate members having a common longitudinal linear edge and defining an obtuse angle between the lower surfaces thereof such that said blade has a downwardly opening V-shape, each of said plate members having an alternating series of openings and upright V-shaped members formed thereon, said openings extending through said plates and being elongated in the lengthwise direction of said blade, said V-shaped members being formed on the upper sides of each of said plate members, the V-shaped members of each one of said plate members opening horizontally in the same direction, and the V-shaped members of one of said plate members opening horizontally in a diametrically opposite direction to the V-shaped members of the other plate member, each of said series extending along the length of each of said plate members parallel to said common longitudinal edge, and said series being parallel but out of phase with each other such that each of the V-shaped members of one plate member is aligned with an opening of the other plate member on a diametrically opposite lateral side of said common longitudinal edge therefrom;

a pair of elongated flexible strips mounted on the upper sides of each of said plate members, each of said flexible strips extending beyond the lower edge of the associated plate member over substantially the entire length thereof, the respective lower edges of said flexible strips both being parallel with said common longitudinal edge of said plate members, and said lower edges of said strips being in close proximity to said horizontal bed; and means for reciprocating said support frame along the length of said side walls of said mortar tank, whereby said blade can be drawn horizontally back and forth through cement mortar in said tank.

10. A stirring apparatus as claimed in claim 9, wherein said support frame comprises said vertical end supports, a pair of upper and lower horizontal support rods connected at opposite ends thereof with said vertical supports at respective upper and lower ends of said vertical supports, and a plurality of intermediate vertical supports connected to said stirring blade at the lower ends thereof and connected to said upper horizontal support rod at the upper ends thereof, said intermediate supports being located between said pair of vertical end supports.

11. A stirring apparatus as claimed in claim 9, wherein said stirring blade is mounted over said horizontal support rod such that said horizontal support rod extends underneath said stirring blade parallel to said common longitudinal edge of said plate members.

* * * * *